United States Patent [19]

Lewis

[11] 4,208,753

[45] Jun. 24, 1980

[54] FLOOR CLEANING APPARATUS

[76] Inventor: Helen M. Lewis, 400 Park Ave. Apt. 201, Calumet City, Ill. 60409

[21] Appl. No.: 955,931

[22] Filed: Oct. 31, 1978

[51] Int. Cl.[2] ..... A46B 13/04

[52] U.S. Cl. ..... 15/29

[58] Field of Search ..... 15/23, 24, 28, 29, 50 R, 15/98, 49 R, 320

[56] References Cited

U.S. PATENT DOCUMENTS

| | | | |
|---|---|---|---|
| 1,507,349 | 9/1924 | Franz | 15/29 |
| 1,860,168 | 5/1932 | Bedard | 15/50 R |
| 3,099,028 | 7/1963 | Ardito | 15/50 R |
| 3,526,916 | 9/1970 | Thomas et al. | 15/29 |

FOREIGN PATENT DOCUMENTS 256212 2/1927 United Kingdom .

*Primary Examiner*—Edward L. Roberts

*Attorney, Agent, or Firm*—Sabin C. Bronson

[57] ABSTRACT

An improved apparatus, particularly applicable for shampooing corners of wall-to-wall carpeting comprises an elongated, hand gripped shaft in two segments structured to allow the apparatus to be pointed into the corners of such carpeting, a container secured to the shaft to store shampoo for use in the apparatus; a rotatable brush secured to the shaft acting to contact and clean the carpeting; and a conduit providing shampoo from the container to the brush. A system which allows the operator to control when and how much shampoo is released from the container is also disclosed.

4 Claims, 3 Drawing Figures

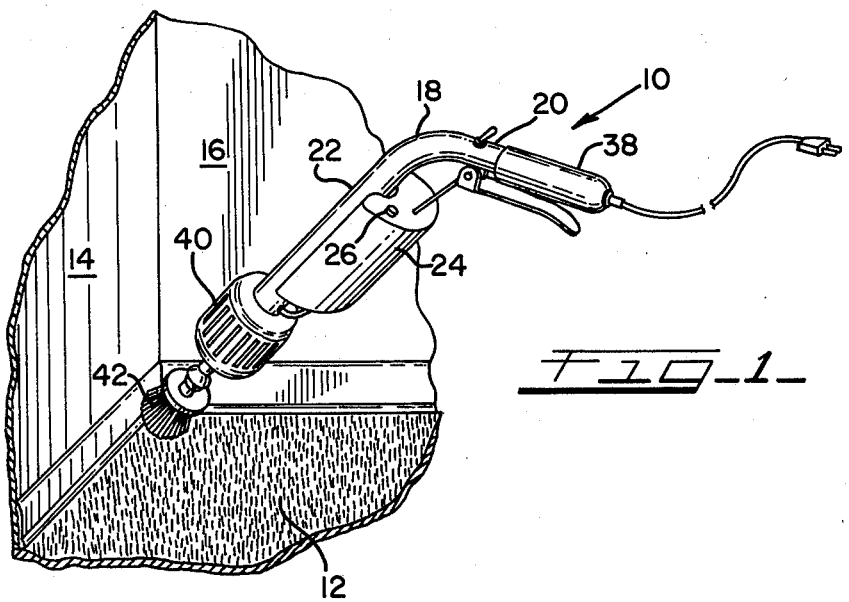
FIG. 1
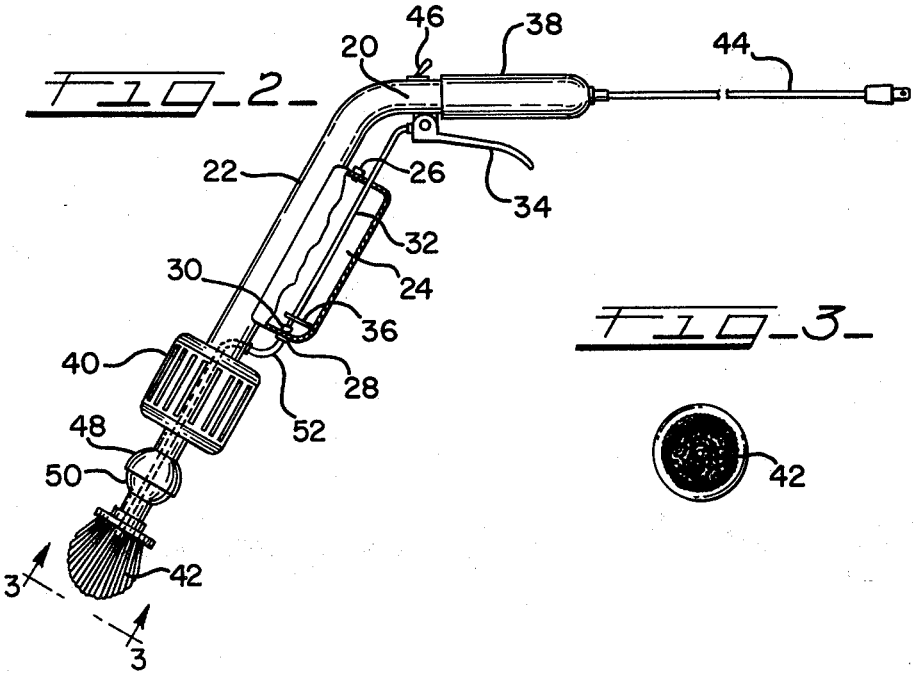
FIG. 2
FIG. 3

FLOOR CLEANING APPARATUS

BACKGROUND AND SUMMARY OF THE INVENTION

This invention relates to an apparatus for treating floors. More particularly, the invention relates to an apparatus useful in cleaning, e.g., shampooing, floors covered by rugs, carpets and the like.

Many homes, offices and the like have wall-to-wall carpeting installed. This floor covering requires periodic cleaning, e.g., shampooing, which is often accomplished with the carpeting in place. One problem which arises with regard to this type of cleaning is that certain areas of the floor covering are hard to reach with conventional cleaning apparatus. Such areas, for example, floor corners, often must be cleaned manually, instead of by machine. A device capable of reaching and cleaning such areas would clearly be advantageous.

U.S. Pat. No. (Re-issue) 25,556 discloses an apparatus for cleaning floors which apparatus carries a supply of cleaning fluid which is applied to the floor. However, this manually propelled apparatus is structured so that the user would often find it difficult, if not impossible, to properly clean the corners of the floor.

Therefore, one object of the present invention is to provide an improved apparatus for treating, e.g., cleaning, shampooing, polishing and the like, floors.

Another object of the present invention is to provide an improved apparatus for treating floors which is especially useful in treating floor corners and other hard-to-reach areas. Other objects and advantages of the present invention will become apparent hereinafter.

An improved apparatus to be used by a human user for treating floors, e.g., covered by rugs, carpets and the like, has now been discovered. The apparatus comprises an elongated shaft (preferably at least partially hollow) made up of two segments structured such that the smallest angle formed by the two segments is an obtuse angle, i.e., an angle greater than 90° and less than 180°. A handle, or grip, is located on (preferably at the end of) the first segment of the shaft to allow the user to hand operate the apparatus. A rotatable contact element is secured to the second segment; preferably to the end of the second segment of the shaft and acts to contact and thereby treat the floor. A container is secured to the shaft, preferably to the second segment of the shaft, and provides for storing treating liquid, e.g., shampoo, to be used by the apparatus. A conduit provides fluid communication between the container and the contact element to allow treating liquid from the container to be transported to the contact element to aid in treating the floor.

The present apparatus is effective in treating, e.g., cleaning, shampooing, polishing, etc., floor coverings while such coverings remain in place. Of particular importance is the ability of the present apparatus to effectively treat the corners of floor coverings or floors which abut against walls, e.g., wall-to-wall rugs and carpeting. (Throughout the description of the present invention, the terms "floor" and "floor covering" are used interchangably, both terms referring to the area to be treated.) The obtuse angle formed by the two shaft segments allows the user to "point" the rotatable contact element directly into the corner of the floor while maintaining a comfortable grip on the handle of the apparatus. The treating liquid is delivered from the container through the conduit to the contact element to treat or shampoo, the corner of the rug or carpet as completely as other areas of the floor covering.

In one embodiment, the present device further includes a control system associated with the container to allow the user to control the release of treating liquid, e.g., shampoo, from the container. Thus, the user is enabled to apply the liquid in amounts he or she deems appropriate, depending, for example, on the amount and type of soil present on the floor covering. In one preferred structure, the control system includes a valve means to restrict the flow of treating liquid from the container to the contact element. A release means is secured to the shaft. A rod provides mechanical communication between the release and the valve so that when the user applies force to the release, the valve opens in response thereto to allow the treating liquid to pass from the container to the contact element. More preferably, this release is located in proximity to the handle on the shaft's first segment. The control system is preferably biased constructed so that the valve completely restricts, i.e., prevents, the flow of treating liquid when no external force, e.g., from the user, is applied to the release. The preferred control systems allow the user to apply liquid to the floor covering when he or she desires without having to interrupt the operation of the apparatus to do so.

Referring now in more detail to certain of the elements of the present apparatus, the elongated shaft is preferably at least partially hollow, for reasons which will become apparent. The shaft includes two segments which may be derived from bending, or otherwise manipulating, a single piece of material, or by attaching two separate pieces together. In order to give the apparatus the desired orientation to be capable of treating floor corners, these two segments are aligned so that the smallest angle formed by the segments is an obtuse angle, preferably in the range of about 100° to about 150°. The "smallest angle" described above is the smallest angle defined by the intersection of the longitudinal axes of the two segments of the shaft.

The handle is preferably located at the end of the first shaft segment away from the point at which the two segments intersect. This handle may be of standard design and configuration and is often structured to be gripped by one hand of the user. The handle allows the user to hand guide the apparatus to whichever area of the floor he or she desires.

The rotatable contact element is preferably secured, either directly or indirectly, to the end of the second segment away from the intersection of the two shaft segments. The contact element preferably rotates in response to the forces created by an electrically powered motor, which motor is secured to the second segment of the shaft. A cord providing electrical communication between the motor and a source of electrical power may be conveniently passed through the hollow shaft. In one configuration, the electrically powered motor is secured directly to the second segment of the shaft, and the contact element is secured to the motor. In this instance, the contact element can be considered to be indirectly secured to the shaft's second segment.

The contact element often includes a brush means, preferably detachably secured to the apparatus, to contact and thereby treat or clean—the floor or floor covering. The brush element may be made of any suitable material, such as those conventionally used to clean or otherwise treat the floor under consideration. In one preferred embodiment, the brush of the contact element is structured or configured so as to be capable of effectively contacting and treating right angled corners of floors which abut against vertically extending walls. In this embodiment, the user may choose to employ this corner configured brush to treat the entire floor. Alternately, the operator may wish to change brushes depending on which area of the floor is to be treated. The present apparatus preferably includes a detachable brush means with which various brushes may be used as desired. Thus, this device has substantial flexibility while providing the important benefit of being able to efficiently clean floor corners.

The container preferably secured to the second segment of the shaft provides a stored supply of treating liquid to be used by the present apparatus. The container includes a liquid outlet through which the treating liquid leaves the container and enters the conduit on the way toward the contact element. The container also may contain a liquid inlet through which treating liquid, or a liquid component thereof, may be introduced into the container in preparation for use. In one preferred embodiment the container extends out from only a portion of the shaft's second segment (i.e., the container does not completely surround the second segment) and the side of the second segment, away from the first segment, is left substantially exposed (i.e., does not have the container extending therefrom). This preferred container configuration provides additional manuerverability for cleaning or otherwise treating floor corners without damaging the abutting walls.

The conduit, which provides fluid communication between the container and the contact element, preferably has a substantially uniform cross-sectional area throughout its length. In addition, this conduit is preferably located at least partially within the hollow shaft. In order that treating liquid be delivered as close as possible to the floor area, e.g., floor corners, desired to be treated, the conduit preferably extends into the brush.

These and other aspects and advantages of the present invention are set forth in the following detailed description and claims, particularly when considered in conjunction with the accompanying drawings in which like parts bear like reference numerals.

BRIEF DESCRIPTION OF THE DRAWINGS

FIG. 1 is a top-side view, in perspective, of an embodiment of the present apparatus in operation.

FIG. 2 is a side elevation view, partly in section, of the apparatus illustrated in FIG. 1.

FIG. 3 is an end view of the brush of the apparatus taken along line 3—3 of FIG. 2.

DESCRIPTION OF THE PREFERRED EMBODIMENT

Referring now to the drawings, a carpet cleaning apparatus according to the present invention, indicated generally at 10, is shown in FIG. 1, in operation, cleaning one corner of carpeting 12 which is abutted against walls 14 and 16. Apparatus 10 includes an elongated tube 18 which is bent to form first member 20 and second member 22 in such a manner that the smallest angle formed by the intersection of the longitudinal axes of the first member 20 and second member 22 is obtuse, as illustrated, about 120°.

Tank 24 is secured to an partially surrounds second member 22 and acts to store shampoo for use by apparatus 10. Tank 24 includes a capped inlet 26 which, when open, allows shampoo to be added to tank 24, and outlet 28, which allows shampoo to pass from tank 24. Plug valve 30 acts to control the flow of shampoo from tank 24 through outlet 28. Plug valve 28 is attached to rod 32 which, in turn, is associated with lever 34. Lever 34 is secured to first member 20 and is constructed so that when no external forces are applied to lever 34 valve 30 completely prevents the flow of shampoo from tank 24. If the operator of apparatus 10 squeezes lever 34 toward first member 20, rod 32 and valve 30 will move in response to this squeezing of lever 34 to allow a quantity of shampoo to exit from tank 24 through outlet 28. After sufficient shampoo has exited tank 24, lever 34 is released, which causes valve 30 to again close, completely restricting flow through outlet 28. Support member 36, secured to the interior wall of tank 24, acts to keep rod 32 and valve 30 in proper alignment.

Hand grip 38 is attached to the end of first member 20 and acts to provide a convenient handle for the human user in guiding apparatus 10 and rug 12.

An electrical motor, illustrated at 40, is secured to the end of second member 22, and acts to provide rotation to brush 42, as will be described hereinafter. Electrical Power is supplied to motor 40 through cord 44 which extends through tube 18, and out of handle 38. Switch 46 is provided to allow the user to turn motor 40 on or off, as desired.

Motor 40 provides rotation directly to connector 48. Brush 42 is secured to attachment 50 which is detachably secured into connector 48. In this manner, motor 40 provides rotation to brush 42.

Shampoo from tank 24 is supplied to brush 42 as follows. Conduit 52, which has a substantially uniform cross-sectional area throughout its length, provides liquid communication between outlet 28 of tank 24 and brush 42. Note that conduit 52 terminates directly within brush 42, thus insuring that shampoo from tank 24 is properly and most effectively applied to the rug 12, as desired.

Apparatus 10 functions as follows. The operator holds hand grip 38 and directs the brush 42 to the area of rug 12 to be shampooed. Once this area, e.g., a corner of rug 12, is located, the operator squeezes lever 34 to dispense a quantity of shampoo to brush 42 and rug 12, and turns switch 46 on to activate motor 40. The configuration of apparatus 10 allows a complete and efficient shampooing of all of rug 12, including the corners thereof. Additional shampoo can be supplied from tank 24 by again squeezing lever 34. Brush 42 is designed to be capable of effectively contacting the right angle corners of rug 12. For areas away from the corners of rug 12, brush 42 may be replaced by other brush attachments. When the shampooing operation is complete, switch 46 is released.

The present apparatus providew substantial benefits. The device is conveniently and comfortably guided to all areas of a floor to be cleaned. In particular, this system is capable of cleaning or otherwise treating floor corners without putting undue strain on the operator. In other words, the present apparatus can be pointed directly into the floor corners without causing the operator to assume an awkward position and, also, without damaging the walls which abut the floor corner.

While this invention has been described with respect to various specific embodiments and examples, it is to be understood that the invention is not limited thereto and that it can be variously practiced within the scope of the following claims.

I claim:

1. An apparatus for manually treating a floor comprising in combination an elongated hollow shaft bent near one end at an obtuse angle to form a handle portion at said end for a user to hand operate said apparatus; a container removably secured to said shaft for storing cleaning liquid therein; an electric motor secured axially to the other end of said shaft, a rotatable connector axially connected to said motor; a brush means removably connected axially to said connector and rotated thereby; a conduit partially located within said shaft and providing liquid communication from said container through said motor and said connector to said brush means; and control means associated with said handle for selectively allowing liquid from said container to pass to said brush means.

2. The apparatus of claim 1, said brush means being configured so as to be capable of effectively contacting right angle corners of floors which abut against vertically extending walls, and said conduit extends into said brush means.

3. The apparatus of claim 2 wherein said control means comprises: valve means to restrict the flow of treating liquid from said container to said brush means; release means secured to said shaft; and a rod providing mechanical communication between said release means and said valve means so that when said user applies force to said release means said valve means opens to allow treating liquid to pass from said container to said brush means.

4. The apparatus of claim 3 wherein said release means is located in proximity to said handle means, and said control means is biasly constructed so that said valve means completely restricts the flow of said treating liquid when no external force is applied to said release means.

* * * * *